US007585231B2

(12) United States Patent
Matsumoto et al.

(10) Patent No.: US 7,585,231 B2
(45) Date of Patent: Sep. 8, 2009

(54) GOLF CLUB SHAFT

(75) Inventors: Norio Matsumoto, Haramachi (JP); Masaki Wakabayashi, Haramachi (JP); Hideaki Sanekata, Haramachi (JP)

(73) Assignee: Fujikura Rubber Ltd., Tokyo (JP)

( * ) Notice: Subject to any disclaimer, the term of this patent is extended or adjusted under 35 U.S.C. 154(b) by 0 days.

(21) Appl. No.: 11/604,549

(22) Filed: Nov. 27, 2006

(65) Prior Publication Data

US 2007/0072697 A1 Mar. 29, 2007

Related U.S. Application Data

(62) Division of application No. 10/844,106, filed on May 12, 2004, now Pat. No. 7,172,518.

(30) Foreign Application Priority Data

May 12, 2003 (JP) ..... 2003-132763

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS

| | | | | |
|---|---|---|---|---|
| 4,157,181 | A | 6/1979 | Cecka | |
| 4,455,022 | A | 6/1984 | Wright | |
| 5,088,735 | A | 2/1992 | Shigetoh | |
| 5,326,099 | A | 7/1994 | Yamamoto | |
| 5,599,612 | A | 2/1997 | Muraki et al. | |
| 5,599,856 | A | 2/1997 | Gardner | |
| 5,633,074 | A | 5/1997 | Muroi et al. | |
| 5,653,646 | A | 8/1997 | Negishi et al. | |
| 5,686,155 | A | 11/1997 | Suzue et al. | |
| 5,984,804 | A | 11/1999 | Berg | |
| 6,270,426 | B1 | 8/2001 | Matsumoto | |
| 6,555,220 | B1 * | 4/2003 | Koyanagi et al. | 428/373 |
| 6,572,490 | B2 * | 6/2003 | Ashida | 473/319 |
| 2002/0003004 | A1 | 1/2002 | Guckert et al. | |

* cited by examiner

*Primary Examiner*—Stephen L. Blau
(74) *Attorney, Agent, or Firm*—William L. Androlia; H. Henry Koda

(57) ABSTRACT

It is object of the present invention to provide a golf club shaft superior in accuracy, minimizing a displacement between thermosetting resin layers, capable of obtaining a feeling close to the feeling of a steel shaft, and superior in stability. To solve the above problems, a golf club shaft of the present invention uses a golf club shaft comprising a torsional rigidity holding layer made of thermosetting resin including reinforcing fibers diagonally crossed in the longitudinal direction of said shaft and a UD flexural rigidity holding layer made of thermosetting resin including reinforcing fibers aligned in parallel to the longitudinal direction of said shaft, characterized in that at least a part of said torsional rigidity holding layer includes a plain weave fabric layer obtained by winding and curing like a shaft-shape a plain weave prepreg which lets a plain weave fabric having mutually woven warps and wefts impregnate with thermosetting resin in such a way that said warps and wefts are diagonally crossed in the longitudinal direction of said shaft.

11 Claims, 8 Drawing Sheets

GOLF CLUB SHAFT

This is a Divisional Application of application Ser. No. 10/844,106, filed May 12, 2004, which is hereby incorporated in its entirety by reference.

BACKGROUND OF THE INVENTION

1. Field of the Invention

The present invention relates to a golf club shaft, more particularly to a golf club shaft having a feeling similar to the feeling of a steel shaft and being superior in stability.

2. Prior Art

FIG. 8 is a perspective view showing a configuration of a conventional plastic golf club shaft. As shown in FIG. 8, the golf club shaft has a structure having a torsional rigidity holding layer 1 in which reinforcing fibers are diagonally crossed, a flexural rigidity holding layer 2 in which reinforcing fibers are aligned in a direction parallel with the longitudinal direction of the shaft, and optionally a compressive rigidity holding layer 3 in which reinforcing fibers are aligned in the direction vertical to the longitudinal direction of the shaft. Typically, the golf shaft is formed by 4 to 6 plies of the torsional rigidity holding layer 1 and 4 to 6 plies of the flexural rigidity holding layer 2 (e.g. Specification of Japanese Patent Application No. 311678/1995).

In the case of a conventional plastic shaft, optionally a prepreg in which reinforcing fibers are aligned in the direction vertical to the longitudinal direction of the shaft is wound on a tapered shaft-like metallic mandrel. Thereafter, a prepreg sheet 4 in which reinforcing fibers are diagonally crossed is wound on the above mentioned prepreg layer. As shown in FIG. 9, the prepreg sheet 4 is made such that overlapping a titled prepreg 41 in which reinforcing fibers such as carbon fibers are diagonally set in a predetermined direction with an incline prepreg 42 in which reinforcing fibers are set in the direction opposite to the predetermined direction. Then a prepreg sheet in which reinforcing fibers are set in the direction parallel with the longitudinal direction is wound on the prepreg sheet 4, then a tape is spirally wound on the prepregs for setting, and a thermosetting resin contained in the prepreg sheets is thermally cured. Hereafter, a prepreg in which reinforcing fibers are aligned in the uni-direction is referred to as a UD prepreg. In this case, the concept of the UD prepreg includes not only the prepreg in which reinforcing fibers are aligned in a direction parallel with and vertical to the longitudinal direction of the shaft but also the incline prepreg 41 in which reinforcing fibers are set on a slant to a predetermined direction and the titled prepreg 42 in which reinforcing fibers are set the direction opposite to the predetermined direction.

In the case of the golf club shaft manufactured in accordance with the above method, a tape trace for setting is formed on the surface of the shaft. Therefore, the shaft is formed into a product by polishing the surface of the above outermost-surface flexural rigidity holding layer, removing the tape trace and smoothing the surface, applying painting and printing to the surface, and then forming a transparent surface layer.

The above plastic shaft is basically manufactured by curing the thermosetting resin contained in the UD prepreg layer in which reinforcing fibers are aligned in one direction as described above. However, though a reinforcing fiber (in the case of carbon fiber) has an elongation of 1.5%, a plurality of thermosetting resin layers has a small strength and a large flexibility compared to the reinforcing fiber. Therefore, the thermosetting resin layer shows a sufficient effect in the direction in which reinforcing fibers are aligned. However, it has a problem that a deformation or displacement occurs between thermosetting resin layers when a force is applied in the thickness direction or transverse direction. When taking a shot by a club using the golf shaft manufactured as described above, a problem occurs that a stable shot cannot be easily taken due to a displacement or deformation between thermosetting fiber layers. Therefore, a fluctuation may occur in direction and carry. Moreover, the above displacement between thermosetting resin layers may deteriorate the feeling of a shot. That is, though a golf senior tends to like the feeling of a steel shaft, the above displacement between thermosetting resin layers has a problem that it causes a feeling separate from the feeling of a steel shaft.

Moreover, the torsional rigidity holding layer 1 is formed by adhering the UD prepregs 41 and 42. So it has a problem that accuracy of shaft is not improved due to a displacement for laminating the prepregs. Furthermore, because laminating is performed, a problem occurs that the number of steps increases and the workability is deteriorated. Hereafter, the above torsional rigidity holding layer is referred to as a UD torsional rigidity holding layer.

SUMMARY OF THE INVENTION

It is an object of the present invention to provide a golf club shaft requiring a less number of steps, superior in workability, and capable of being easily manufactured. It is another object of the present invention to provide a golf club shaft superior in accuracy, minimizing a displacement between thermosetting resin layers, capable of obtaining a feeling close to the feeling of a steel shaft, and superior in stability.

To solve the above problems, a golf club shaft of the present invention uses a golf club shaft comprising a torsional rigidity holding layer made of thermosetting resin including reinforcing fibers diagonally crossed in the longitudinal direction of said shaft and a UD flexural rigidity holding layer made of thermosetting resin including reinforcing fibers aligned in parallel to the longitudinal direction of said shaft, characterized in that at least a part of said torsional rigidity holding layer includes a plain weave fabric layer obtained by winding and curing like a shaft-shape a plain weave prepreg which lets a plain weave fabric having mutually woven warps and wefts impregnate with thermosetting resin in such a way that said warps and wefts are diagonally crossed in the longitudinal direction of said shaft.

Moreover, a golf club shaft of the present invention uses a golf club shaft comprising a torsional rigidity holding layer made of a thermosetting resin including reinforcing fibers diagonally crossed in the longitudinal direction of the shaft and a flexural rigidity holding layer made of a thermosetting resin having reinforcing fibers aligned in the longitudinal direction of the shaft, characterized in that the torsional rigidity holding layer has a plain weave fabric layer formed by winding a prepreg obtained by impregnating a plain weave fabric having mutually woven warps and wefts with a thermosetting resin like a shaft so that the warps and wefts are diagonally crossed in the longitudinal direction of the shaft and curing the prepreg and a triaxial fabric layer formed by winding a prepreg obtained by impregnating a triaxial fabric having first warps inclined from wefts and second warps diagonally crossing with the warps with a thermosetting resin like a shaft, in which these wefts and first and second warps are woven by alternately passing through upsides and downsides of yarns so that the wefts become parallel with or vertical to the longitudinal direction of the shaft and curing the prepreg.

According to the first inventions of the present invention, a torsional rigidity holding layer includes a plain weave fabric layer thermally cured thermosetting resin impregnated to a plain weave fabric. The plain weave fabric is woven by warps and wefts and movements of yarns are restricted. Therefore, a warp exerts a drag against a longitudinal force and a weft exerts a drag against a transverse force. Therefore, it is possible to effectively restrain a deformation of or displacement between thermosetting resin layers. Therefore, advantage can be obtained that since it is possible to restrain a displacement between layers at the time of a shot, there are improved stabilities of distance and direction. Another advantages can be given that a soft feeling is obtained compared to the case of only a triaxial fabric layer, return of bowing becomes slow, and a hitting easiness is improved. These characteristics are the most suitable for an iron club including a putter.

Moreover, the second invention of the present invention uses a plain weave fabric layer formed by impregnating a plain weave fabric with a thermosetting resin and curing the thermosetting resin and a triaxial fabric layer using a triaxial fabric as a torsional rigidity holding layer. Because the plain weave fabric and triaxial fabric are respectively woven by warps and wefts and movements of yarns are restricted. Therefore, it is possible to effectively restrain a deformation of or a displacement between thermosetting resin layers. Moreover, because it is not necessary to adhering the prepreg 41 with the prepreg 42, it is possible to manufacture a golf club shaft requiring a less number of steps and having high workability and accuracy.

DETAILED DESCRIPTION OF THE PREFERRED EMBODIMENTS

Figure 8:
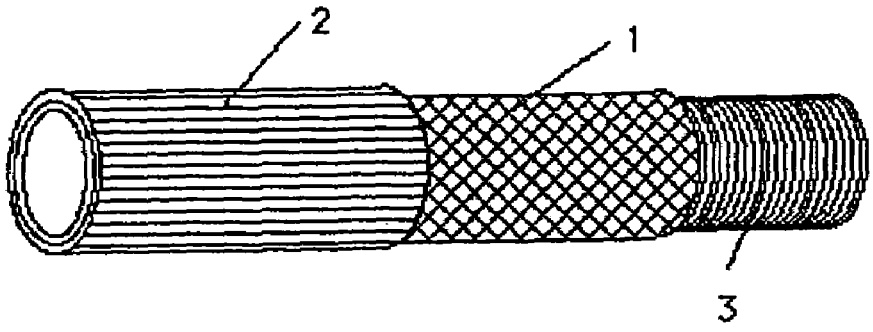
FIG. 8 is an illustration showing a typical structure of a plastic golf club shaft.
Figure 9:
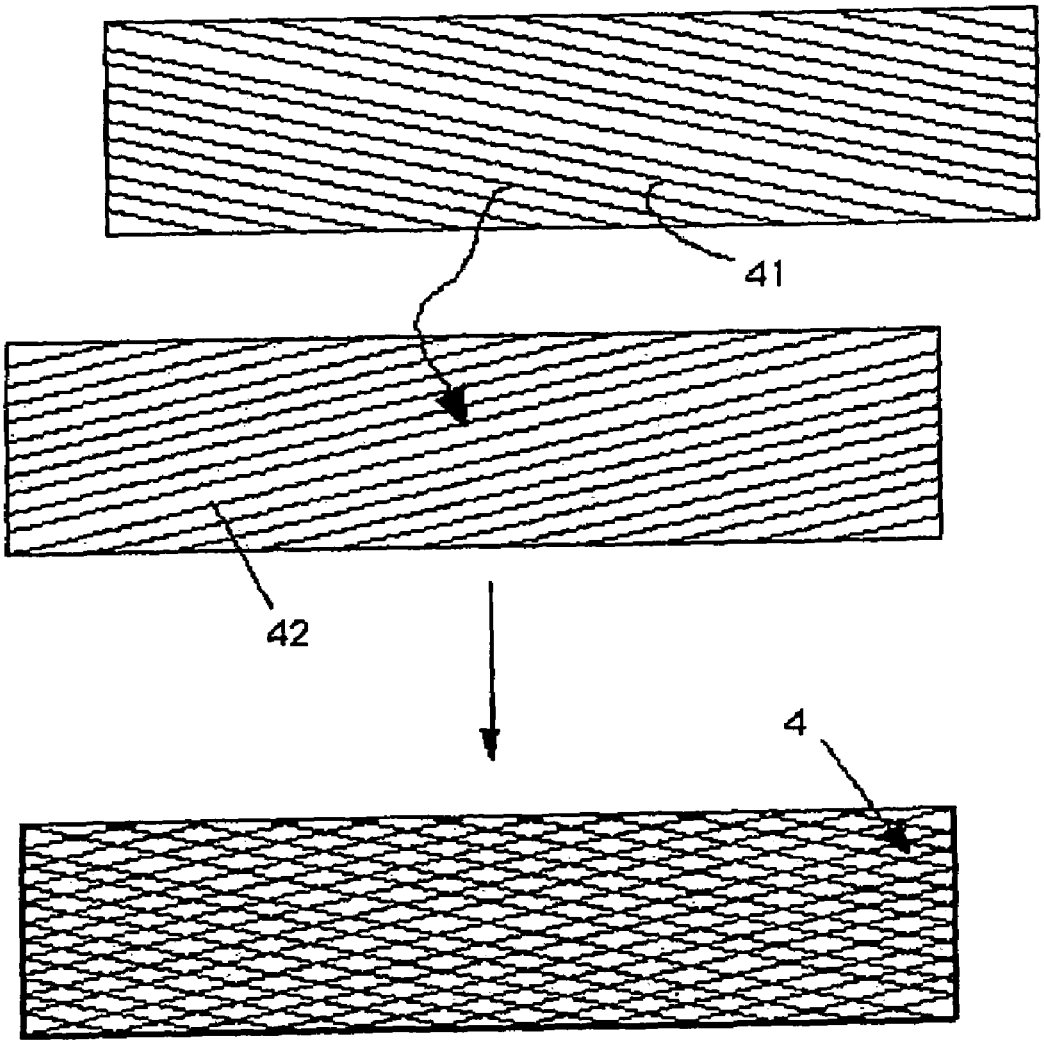
FIG. 9 is a block diagram of a UD prepreg forming a conventional torsional rigidity holding layer.

An embodiment of a golf club shaft of the present invention has a structure in which the UD flexural rigidity holding layer 2 made of a thermosetting resin having reinforcing fibers aligned in parallel with the longitudinal direction of the shaft and the UD compressive rigidity holding layer 3 of a resin layer having reinforcing fibers optionally aligned in the direction vertical to the longitudinal direction of the shaft are formed on the torsional rigidity holding layer 1 made of a thermosetting resin having reinforcing fibers diagonally crossed in the longitudinal direction of the shaft the same as the case of FIG. 8. The golf shaft is constituted by 4 to 6 plies of the UD flexural rigidity holding layer 2.

Figure 1:
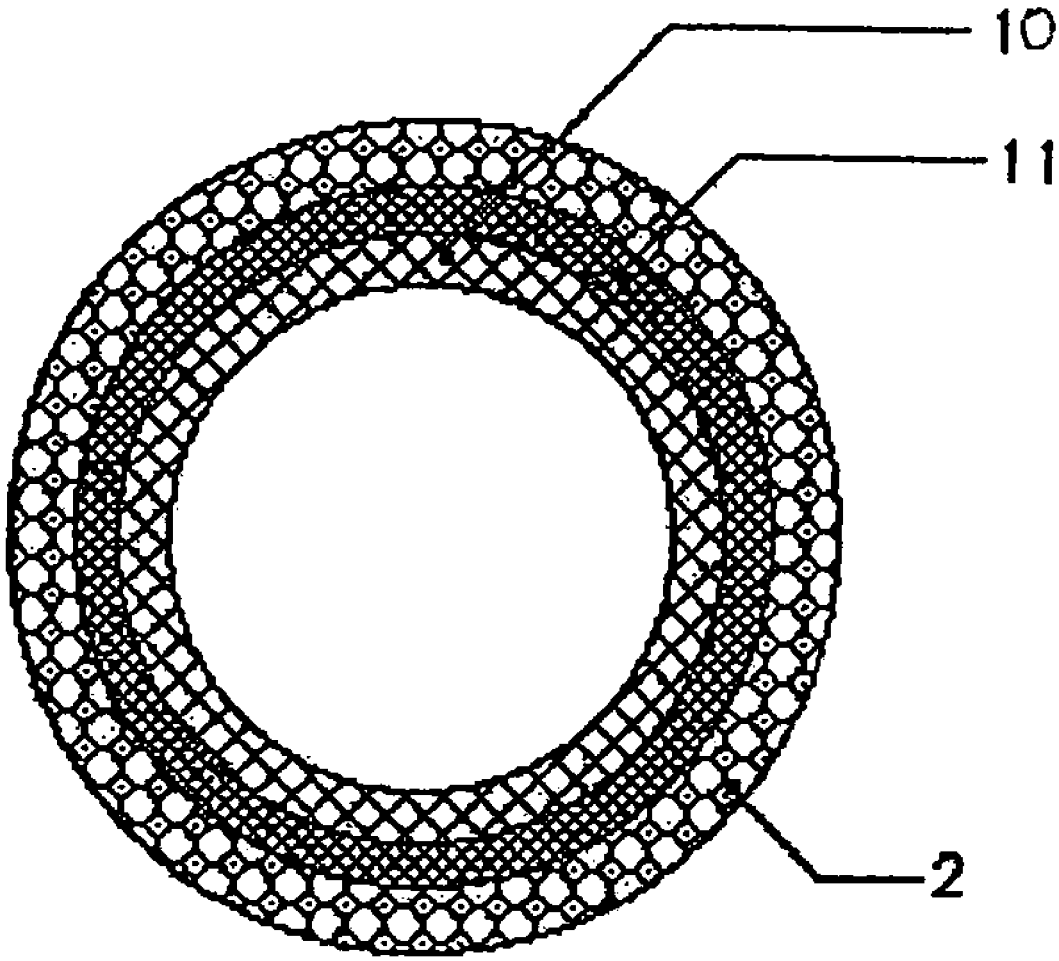
FIG. 1 is a sectional view of a golf shaft of an embodiment of the present invention.

In the case of the above embodiment of the present invention, the plain weave fabric layer 11 formed by curing a plain weave prepreg obtained by impregnating a plain weave fabric with a thermosetting resin is used for at least a part of the torsional rigidity holding layer 1. FIG. 1 shows a preferred embodiment having the above configuration, in which the plain weave fabric layer 11 is formed on the UD torsional rigidity holding layer 10 and moreover, the UD flexural rigidity holding layer 2 is formed on the layer 11.

FIG. 2*a* is a top view of a plain weave fabric used for the present invention and FIG. 2*b* is a sectional view of the fabric. As shown in FIGS. 2*a* and 2*b*, the plain weave fabric 5 has a structure in which a warp 51 and weft 52 are mutually orthogonal to each other and woven. Moreover, the plain weave fabric prepreg is wounded on the mandrel like a shaft and cured so that the warp 51 and weft 52 are mutually crossed at an angle θ of approx. 45° from the longitudinal direction of the shaft. In this case, then angle between the warp 51 and weft 52 on one hand and the axis line of the longitudinal direction may be slightly deviated from 45° depending on winding, the warp 51 and weft 52 are stable because the angle formed between the warp 51 and weft 52 is 2θ, that is, 90°. Therefore, the effect for the torsion of reinforcing fibers become constant and thus, a balance is easily realized even if the warp 51 and weft 52 are not accurately wound. Therefore, the flexibility for design increases and the workability of the shaft is improved. Moreover, when an angle of diagonally crossed reinforcing fibers is 45° from the longitudinal direction of the shaft, it is possible to display the best torsional effect. Therefore, it is preferable to wind a prepreg so that reinforcing fibers mutually become 45° in the longitudinal direction of the shaft as described above.

In the case of a preferable embodiment of the present invention, a yarn of the plain weave fabric uses a carbon fiber. In the case of another embodiment of the present invention, the warp 51 and weft 52 can use alumina fiber, aramid fiber, silicon carbide fiber, amorphous fiber, or glass fiber. That is, the kind of a yarn is not basically restricted.

In the case of an embodiment of the present invention, it is preferable that the thread count of the above plain weave fabric is 4 yarns/cm or more. When the thread count is less than 4 yarns/cm, the thickness of the plain weave fabric increases and the workability may be deteriorated.

Moreover, it is preferable that the thickness of a yarn is 3 K (1 K denotes 1,000 filaments) or less. When the thickness exceeds 3 K, 1 ply becomes too thick and it may not be possible to secure a sufficient fiber density (thread count) and the workability may be deteriorated because the yarn cannot be easily wound on a shaft.

In the case of the present invention, it is possible to basically use any kind of resin for the resin of a prepreg to be impregnated in the above fabric in the case of the present invention. For example, it is possible to use epoxy resin, unsaturated polyester resin, phenol resin, vinylester resin, or peak resin.

It is preferable that the above prepreg has a thickness of 0.3 mm or less. When the thickness exceeds 0.3 mm, 1 ply becomes too thick and thus, it may not be possible to secure a sufficient fiber density (thread count) or the workability may be deteriorated because the prepreg cannot easily be wound on a shaft.

Moreover, it is preferable that the prepreg has a weight of 400 g/m$^2$ or less. When the weight exceeds 400 g/m$^2$, it may become too thick. It is preferable that the resin quantity of the prepreg ranges between 25 and 40 wt %. When the resin quantity is 25 wt % or less, it may not be possible to manufacture a preferable shaft because the resin quantity is too little. However, when the resin quantity exceeds 40 wt %, the torque may become too large when the weight of the shaft is not changed. In this specification, torque shows a torsion degree when one feet·pound is loaded on the rotational direction of the shaft.

In the case of an embodiment of the present invention, the UD flexural rigidity holding layer 2 in which the reinforcing fibers are aligned in the longitudinal direction of a shaft is formed on the torsional rigidity holding layer 1 (plain weave fabric layer 11) which is a resin layer in which the reinforcing fibers form a plane weave fabric as shown in FIG. 8. A prepreg used for the compressive rigidity holding layer 3 can be a UD compressive rigidity holding layer using a conventional UD prepreg. The UD flexural rigidity holding layer 2 constitutes the outermost surface layer of the shaft. The shaft is formed into a product by setting the UD flexural rigidity holding layer 2, polishing the surface of the UD flexural rigidity holding layer 2 serving as the outermost surface layer and smoothing the surface, and then applying painting and printing to the layer 2, and finally forming a transparent surface layer on the layer 2.

Moreover, in the case of still another embodiment, it is possible to form the compressive rigidity holding layer 3 which is a resin layer in which reinforcing fibers are aligned in the direction vertical to the longitudinal direction of a shaft (circumferential direction of shaft) at the inside or outside of the torsional rigidity holding layer 1 (UD torsional rigidity holding layer 10 and/or plain weave fabric layer 11). A prepreg used for the compressive rigidity holding layer 3 can also be a UD compressive rigidity holding layer using a conventional UD prepreg.

Furthermore, in the case of still another embodiment, it is possible to laminate the UD torsional rigidity holding layer 10 formed by a conventional UD prepreg at the outside of the above plain weave fabric layer in order to adjust shaft characteristics such as the hardness, kick point, weight, and torsional rigidity of a shaft. In the case of still another embodiment, it is possible to use the flexural rigidity and/or compressive rigidity holding plain-weave fabric layer formed by curing a plain weave prepreg obtained by impregnating the plain weave fabric with a thermosetting resin. In this case, the flexural rigidity and/or compressive rigidity holding plain-weave fabric layer is manufactured by winding a prepreg so that the warp 51 or weft 52 becomes parallel with the longitudinal direction of a shaft and curing the prepreg. In this case, the wefts 52 (warps 51) aligned in parallel with the longitudinal direction of the shaft contribute to flexural rigidity holding and the wefts 52 (warps 51) vertical to the warps 51 are wound in the direction vertical to the longitudinal direction of the shaft (circumferential direction). Therefore, the wefts 52 contribute to compressive rigidity holding. In this case, it may be possible to obtain the same advantage without forming the compressive rigidity holding layer 3.

When using the above plain weave fabric layer, the UD flexural rigidity holding layer 2 which is a resin layer in which reinforcing fibers are aligned in the longitudinal direction of a shaft or a resin layer not including reinforcing fibers are formed as an outermost surface layer. When the UD flexural rigidity holding layer 2 or the resin layer not including reinforcing fibers is not formed but the fabric layer is present at the outermost surface, fibers of the fabric layer are cut and the function of the fabric layer is deteriorated because the surface of the manufactured shaft is smoothly polished.

In the case of the present invention, it is enough that there are a torsional rigidity holding layer of a plain weave fabric layer and a flexural rigidity holding layer or resin layer not including reinforcing fibers which are formed on the outermost surface. Another configuration, it is possible to variously combine a normal torsional rigidity holding layer and a flexural rigidity holding and compressive rigidity holding plain-weave fabric layers as described above.

Figure 3:
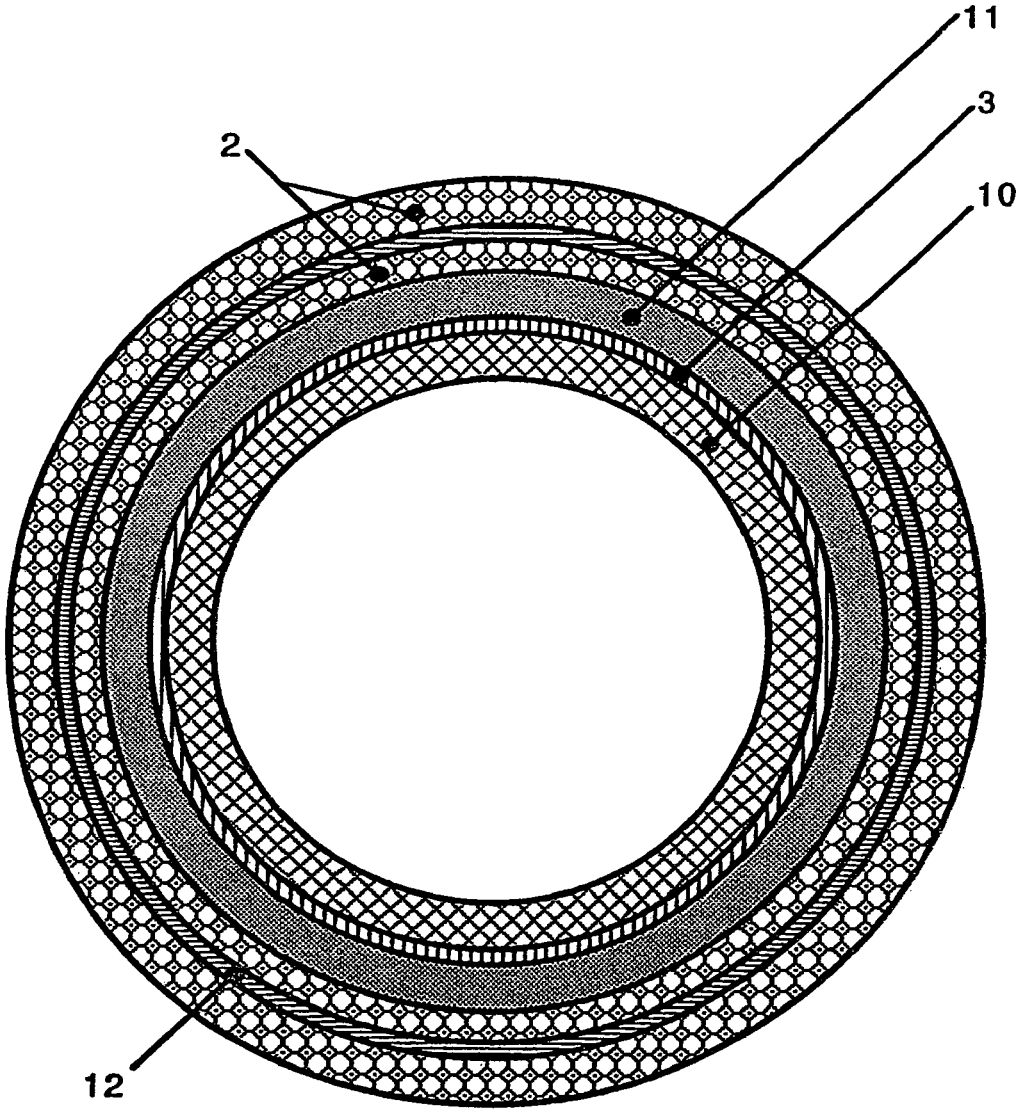
FIG. 3 is a sectional view of a golf club shaft of an embodiment of the present invention.

Moreover, in the case of the present invention, it is allowed to form a triaxial fabric layer together with the above plain weave fabric layers. As a typical configuration of a shaft of the present invention, the UD compressive rigidity holding layer 3 (may be referred to as 90° layer) of a resin layer including the reinforcing fibers optionally aligned in the direction vertical to the longitudinal direction of the shaft is formed {e.g. one layer (1 ply)} on the UD torsional rigidity holding layer 10 formed by curing a plurality of thermosetting resin layers of a UD prepreg sheet (e.g. four layers; in this case, UD prepreg sheet is formed by 2×4 plies) in which reinforcing fibers are diagonally crossed obtained by overlapping the incline prepreg 41 in which reinforcing fibers are diagonally set in a predetermined direction and the incline prepreg 42 in which reinforcing fibers are set in the direction opposite to the predetermined direction as shown in FIG. 3. The torsional rigidity holding layer 1 formed by the plain weave fabric layer 11 is formed on the UD compressive rigidity holding layer 3. It is allowed to use one or more plain weave fabric layers 11 (e.g. three layers).

The triaxial fabric layer 12 is further formed on the laminated layer through or not through one or more UD flexural rigidity holding layers 2 (may be referred to as 0° layer or layers) formed by curing a thermosetting resin layer including reinforcing fibers aligned in parallel with the longitudinal direction and moreover, one or more UD flexural rigidity holding layer 2 or layers 2 of 0° layer or layers is or are formed.

As shown in FIGS. 7*a* and 7*b*, the triaxial fabric layer 12 has a first warp 52 inclined from a weft 51 and a second weft 53 diagonally crossed with the weft 52 and these weft 51, warp 52, and warp 53 are woven by alternately passing through upsides and downsides of yarns and wound like a shaft so that the weft 51 becomes parallel (0° directional) with or vertical (90° directional) to the longitudinal direction of the shaft.

Figure 4:
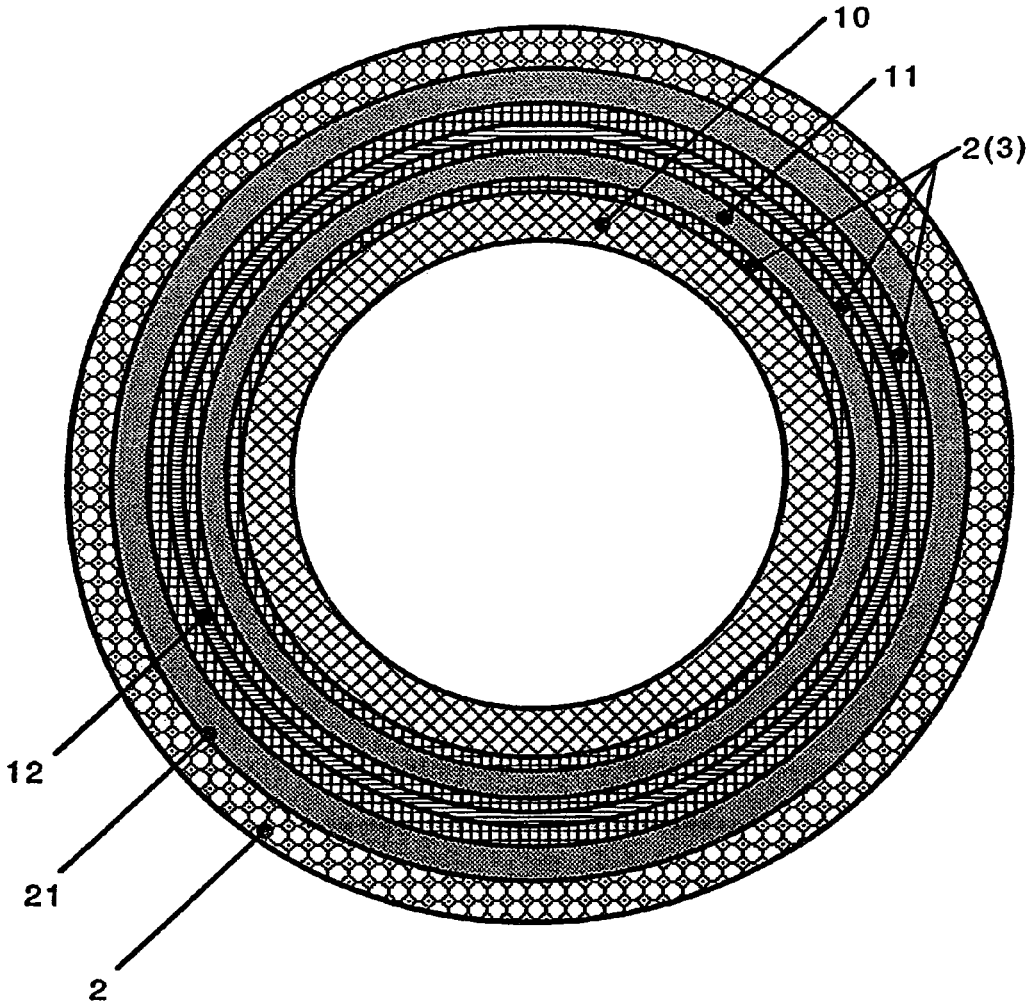
FIG. 4 is a sectional view of a golf club shaft of another embodiment of the present invention.

FIG. 4 shows still preferred embodiment. In the case of this embodiment, one or two UD flexural rigidity holding layer or layer or layers 2 or one or two UD compressive rigidity holding layer or layers 3 (0°or 90° layer or layers) is or are laminated on the UD torsional rigidity holding layers (e.g. four layers; in this case, prepreg sheet is formed by 2×4 plies) 10 formed by mutually overlapping an incline prepreg 41 in which reinforcing fibers are diagonally set in a predetermined direction and an inclined prepreg 42 in which reinforcing fibers are set in the direction opposite to the predetermined direction and curing a plurality of thermosetting resins of the UD prepreg sheet 4 in which reinforcing fibers are diagonally crossed. It is possible to replace the UD torsional holding layer 10 and the UD flexural rigidity holding layer 2 or UD compressive rigidity holding layer 3 (0° layer or 90° layer). That is, it is allowed to first form the 0° layer or 90° layer and then form the UD torsional rigidity holding layer 10.

Torsional rigidity holding layers (e.g. two or three layers) respectively formed by the plain weave fabric layer 11 are formed on the above layer, a triaxial fabric layer 12 is formed on the plain weave fabric layer 11 through the UD flexural rigidity holding layer 2 or the UD compressive rigidity holding layer 3 (0° layer or 90° layer), and moreover plain weave fabric layers 21 (e.g. two or three layers) are formed through or not through the 0° layer or layers 2 or 90° layer or layers 3 (e.g. 1 to 2 layer or layers). The plain weave fabric layer 21 is a layer wound and cured so that warps becomes parallel with the longitudinal direction of a shaft (therefore, wefts become vertical to the longitudinal direction), which is a plain weave fabric layer 21 for holding the flexural rigidity and/or compressive rigidity so as to carry on flexural rigidity and compressive rigidity holding functions.

One or more UD flexural rigidity holding layer or layers (0° layer or layers) 1 is or are further formed on the plain weave fabric layer 21.

Figure 5:
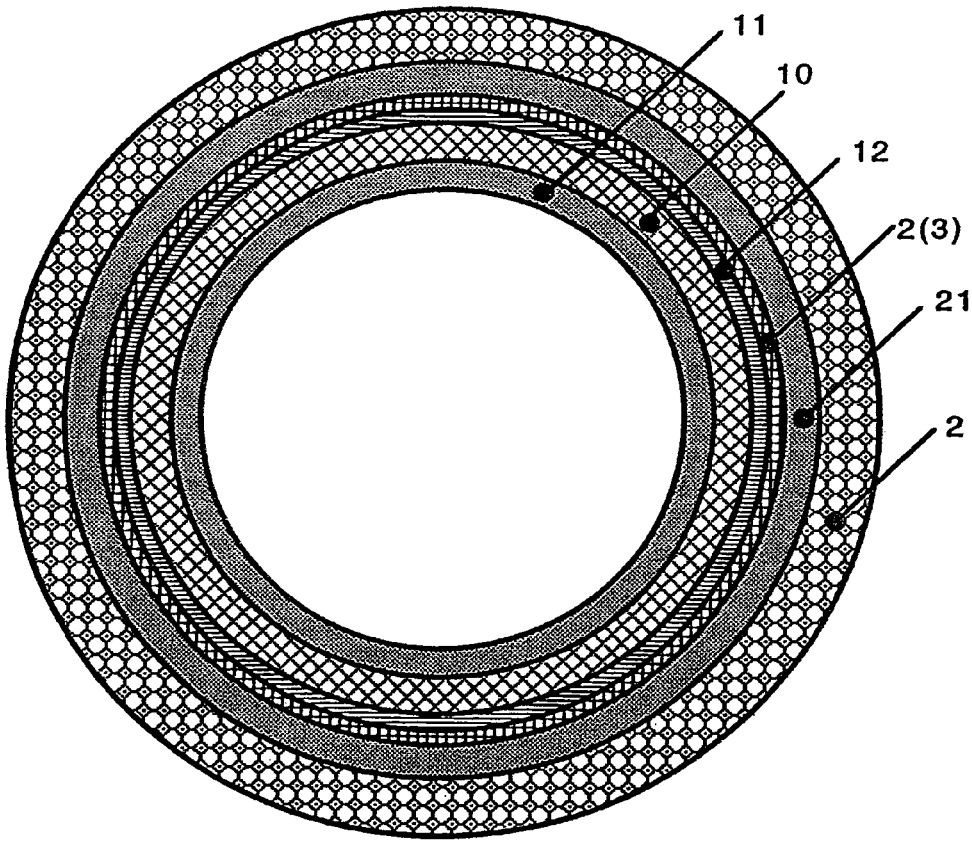
FIG. 5 is a sectional view of a golf club shaft of still another embodiment of the present invention.

In the case of still another embodiment shown in FIG. 5, one or more plain weave fabric layer or layers 11 (e.g. two or three layers) for holding torsional rigidity is or are formed. One or more UD torsional rigidity holding layer or layers 10 is or are formed on the plain weave fabric layer or layers 11, and moreover the triaxial fabric layer 12 is formed and the flexural rigidity and/or compressive rigidity holding plain weave fabric layers or layer 21 are or is formed through the 0° layer 2 or 90° layer 3. The UD flexural rigidity holding layer or layers 2 is or are formed on the plain weave fabric layers or layer 21.

In the case of the golf club shaft, the above plain weave fabric and plain weave prepreg are effectively used for the plain weave fabric layers 11 and 21.

Figure 6:
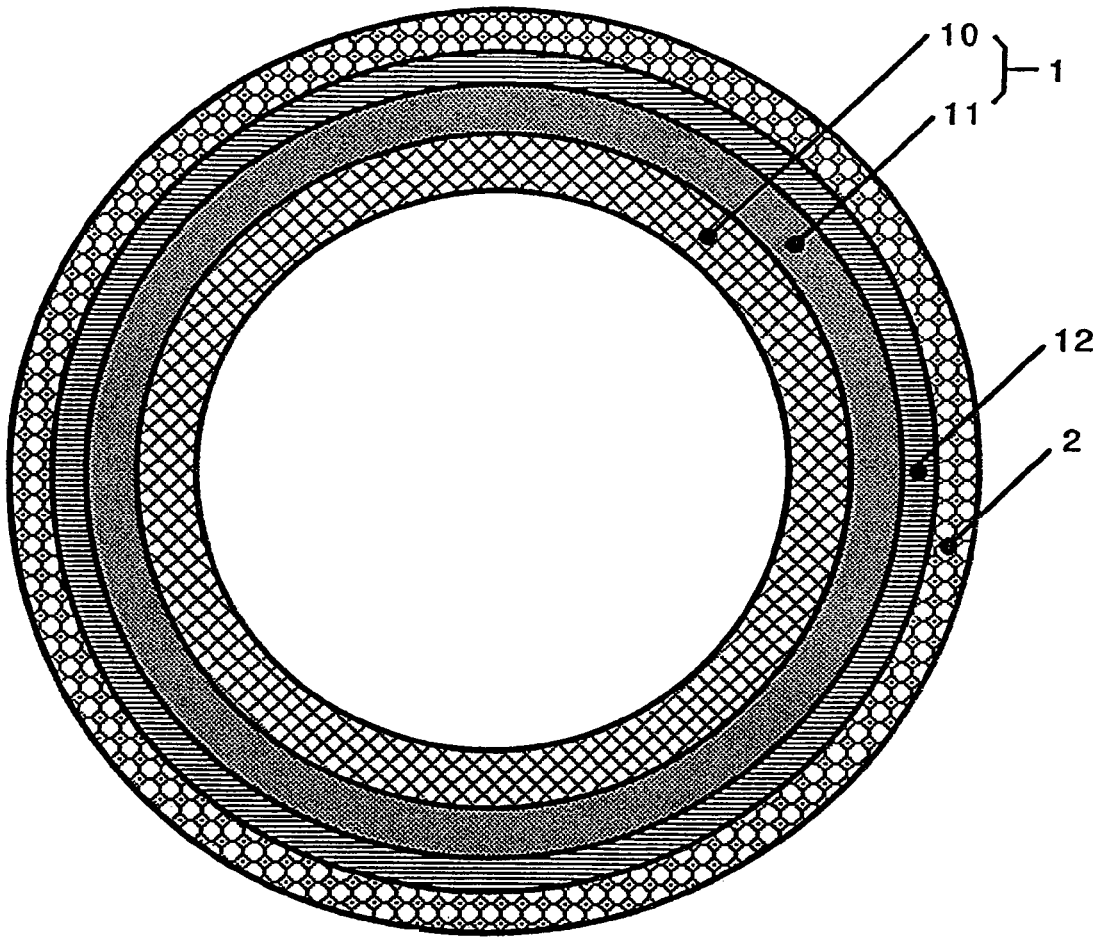
FIG. 6 is a sectional view of a golf club shaft of still another embodiment of the present invention.

In the case of the preferable embodiment shown in FIG. 6, the plain weave fabric layer 11 is formed on the UD torsional rigidity holding 10 and the triaxial fabric layer 12 is formed adjacently to the layer 11. The UD flexural rigidity holding layer 2 is further formed on the triaxial fabric layer 12.

The triaxial fabric 5 has the first warp 52 inclined from the weft 51 and the second warp 53 diagonally crossed with the warp 52. These weft 51, warp 52, and warp 53 are woven by alternately passing through upsides and downsides of yarns.

It is preferable that the angle θ formed between the weft 52 and warp 53 ranges between 25 and 75°. When the angle deviates from the range between 25 and 75°, the isotropy of triaxial weave may be lost and the form retention characteristic may be deteriorated. It is more preferable that the angle ranges between 50 and 70°. Typically, a fabric is preferable which is obtained by knitting yarns in which warp 51 and wefts 52 and 53 mutually form approx. 60°.

Though the warp 51 and wefts 52 and 53 generally use carbon fiber the same as the case of a plain weave fabric, it is also possible to use one of alumina fiber, aramid fiber, silicon carbide fiber, amorphous fiber, and glass fiber. That is, the kind of a yarn is not basically restricted. Moreover, carbon fiber includes the pitch type and pan type both of which can be used. It is allowed that these fibers are different from each other in physical property and moreover different from each other in physical property such as tensile strength or tensile elastic modulus even in the same fiber.

It is preferable that the above triaxial fabric is formed between 32 and 64 gauge. A triaxial fabric out of the above range may deteriorate the performance of a golf club shaft. In the case of a triaxial fabric of 32 gauge, the interval dx between the wefts 51 is 1.80 mm and the interval dy between intersections of the warps 52 and 53 is 2.04 mm. In the case of 64 gauge, the dx is 0.90 mm and dy is 1.04 mm.

It is preferable that the thickness of the above prepreg is 0.4 mm or less. When the thickness exceeds 0.4 mm, 1 ply becomes too thick and a sufficient fiber density (thread count) may not be obtained or the workability of the prepreg may be deteriorated because it is difficult to wind the prepreg on a shaft.

Moreover, it is preferable that the weight of the prepreg is 350 g/m$^2$ or less. When the weight exceeds 350 g/m$^2$, resin is extremely jammed into weave patterns and the prepreg may become extremely thick. It is preferable that the resin quantity of the prepreg ranges between 25 and 50 wt %. When the resin quantity is 25 wt % or less, it may not be possible to manufacture a preferable shaft because the resin quantity is too little. However, when the resin quantity exceeds 50 wt %, the outside diameter of a shaft may become extremely large.

In the case of an embodiment of the present invention, a UD flexural rigidity holding layer 2 or UD compressive rigidity holding layer 3 formed by a 0° layer or 90° layer is set between a plain weave fabric layer 11 and a triaxial fabric layer 12 (that is, between fabric layers). Or, a UD torsional rigidity holding layer 10 is set between them. The above configuration is used to prevent the fabric layers 11 and 12 from directly contacting with each other. When the fabric layers 11 and 12 directly contact with each other, a resin quantity becomes insufficient, the peeling strength between the layers becomes insufficient, and a displacement may occur between the layers. To prevent the above troubles, a 0° layer or 90° layer is set. It is a matter of course that the 0° layer holds a flexural rigidity and the 90° layer holds a compressive rigidity. Moreover, in the case of another embodiment, it is possible to set the plain weave fabric layer 11 and triaxial fabric layer 12 so as to contact with each other (that is, to set fabric layers so as to contact with each other).

In the case of still another embodiment of the present invention, a UD flexural rigidity holding layer 2 is formed on fabric layers 11 and 12 or a fabric layer 21 as shown in FIGS. 3 to 6. The UD flexural rigidity holding layer 2 constitutes the outermost surface layer of a shaft. Moreover, in the case of still another preferred embodiment, a transparent resin layer not including reinforcing fibers is formed on the UD flexural rigidity holding layer 2 or fabric layers 11, 12, and 21. After setting the UD flexural rigidity holding layer 2 and/or the transparent resin layer, the embodiment is formed into a product by polishing and smoothing the surface of the UD flexural rigidity holding layer 2 on the outermost surface layer and then, applying painting and printing to the surface, and forming a transparent surface layer.

In the case of the above embodiment, the triaxial fabric layer 12 and the plain weave fabric layer 11 are formed over the entire length of the shaft. However, it is also possible to form a part of the layer 12 and/or the layer 11 at the chip side and/or bat side. Moreover, it is possible to form a part of the layer 12 and/or the layer 11 at the chip side and/or bat side or independently at the central portion of the shaft.

EXAMPLES 1 AND 2

Figure 2:
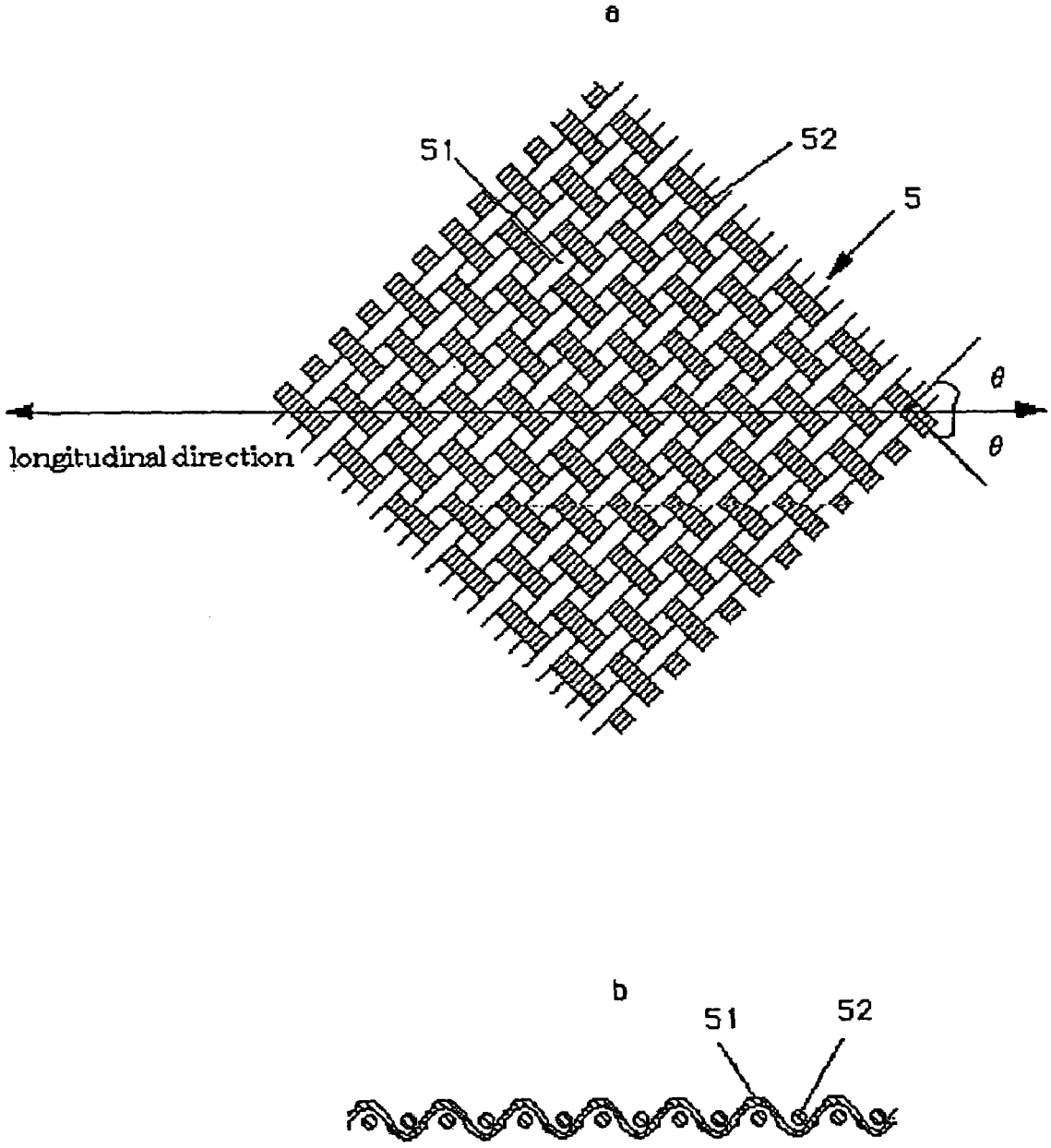
FIG. 2 shows a top view and a sectional view of a plain weave fabric used for a golf club shaft of the present invention.

A golf club shaft is manufactured by using the plain fabric shown in FIG. 2. The golf club shaft is formed by winding a plain weave prepreg (resin quantity=40%; elastic modulus of reinforcing fiber=24 t) of the present invention up to 3 plies, UD prepregs aligned in the direction vertical to the longitudinal direction of the shaft (for each of these prepregs: resin quantity=40%; elastic modulus of reinforcing fiber=24 t) by 1 ply, and a flexural rigidity holding UD prepreg having reinforcing fibers aligned parallel with the longitudinal direction of the shaft (resin quantity=24%; elastic modulus of reinforcing fiber=30 t) up to 2 plies on a mandrel and curing them. The plain weave prepreg is wound like a shaft so that the warp 51 and weft 52 of the plain weave fabric are mutually crossed at an angle θ of approx. 45° from the longitudinal direction of the shaft (example 1).

Moreover, a plain weave prepreg (resin quantity=40%; elastic modulus of reinforcing fiber=24 t) of the present invention is wound like a shaft up to 3 plies so that the warp 51 and weft 52 of the plain weave fabric are mutually crossed at an angle θ of approx. 45° from the longitudinal direction of the shaft (refer to the arrow in FIG. 1). Then, a plain weave prepreg (resin quantity=40%; elastic modulus of reinforcing fiber=24 t) is wound by 1 ply so that the warp 51 or weft 52 becomes parallel with the longitudinal direction of the shaft (or weft or warp becomes vertical to longitudinal direction of shaft). Moreover, a flexural rigidity holding CD prepreg (resin quantity=24%; elastic modulus of reinforcing fiber=30 t) having reinforcing fibers aligned in parallel with the longitudinal direction of the shaft is wound on a mandrel by 2 plies and cured to form a golf club shaft (example 2).

Moreover, for comparison, a golf club shaft is manufactured by using three UD torsional rigidity holding layers (UD prepreg 41=3 plies and UD prepreg 42=3 plies) (resin quantity=40%; elastic modulus of reinforcing fiber=24 t) instead of a plain weave fabric layer, UD prepreg in which reinforcing fibers are aligned in parallel with a shaft by 1 ply, UD prepregs aligned in the direction vertical to the longitudinal direction of the shaft (for each of the above prepregs, resin quantity=40%; elastic modulus of reinforcing fiber=24 t) by 1 ply, and a UD flexural rigidity holding layer (resin quantity=24%; elastic modulus of reinforcing fiber=30 t) up to 2 plies (comparative example 1).

A carbon fiber yarn (3 K) is used as reinforcing fibers of each layer. Moreover, warps and wefts of a plain weave fabric respectively use a carbon fiber. The thickness of each of the warps and wefts is 3 K and the thread count of each of the warps and wefts is 4.9 yarns/cm. Moreover, when using a plain weave prepreg, the thickness is 0.22 mm and the weight is 328 g/m$^2$.

Characteristics of the above golf club shaft are shown below.

TABLE 1

| | Example 1 | Example 2 | Comparative example, |
|---|---|---|---|
| Length | 46 in | 46 in | 46 in |
| Weight | 67.2 g | 67.9 g | 67.8 g |
| Torque | 5.8° | 5.65° | 5.67° |
| Frequency | 245 cpm | 244 cpm | 244 cpm |

Golf club shafts (each shaft length is 45 in) are respectively formed by setting the same grip of 51 g and the same head of 194 g to make a robot hit golf balls under the same condition. The robot is set so that positions of rbi to heads become the same for all clubs and the head speed becomes 40 m/s.

As a result of hitting 100 golf balls at the center of the head of a golf club using the shaft of the example 1 of the present invention, dropping points (carries) of the balls are approx. 198.7 yd±3.75 yd as differences in the back and forth direction (carry) and ±5.5 yd as differences in the transverse direction. Moreover, as a result of hitting 100 golf balls by shifting the hitting position of the head by 10 mm to the toe side, dropping points (carries) of the balls are approx. 196.4 yd±3.9 yd as differences in the back and forth direction (carry) and ±4.5 yd as differences in the transverse direction and differences of carries are the same as the case of hitting balls at the center of the head. However, differences in the transverse direction when shifting the hitting position by 10 mm are smaller.

However, when hitting 100 golf balls by the head of a golf club using the shaft of the example 2 of the present invention, dropping points (carries) of the balls are approx. 197.9 yd±2.95 yd as differences in the back and forth direction (carry) and ±4.1 yd as differences in the transverse direction. Moreover, as a result of hitting 100 golf balls by shifting the hitting position of the head by 10 mm to the toe side, dropping points of the balls are approx. 193.1 yd±3.55 yd as differences in the back and forth direction (carry) and ±3.6 yd as differences in the transverse direction. Though differences of carries are the same as the case of hitting balls at the center of the head, differences in the transverse direction when shifting the hitting position of the head by 10 mm to the toe side are smaller.

In the case of a golf club formed by a conventional shaft, however, dropping points of balls are approx. 193.7 yd±5.7 yd as differences in the back and forth direction (carry) and ±5.85 yd as differences in the transverse direction when hitting the balls at the center of the head of the club. Moreover, as a result of hitting golf balls by shifting the hitting position of the head by 10 mm to the toe side, dropping points of the balls are approx. 193.7 yd±9.25 yd as differences in the back and forth direction (carry) and ±4.5 yd as differences in the transverse direction.

That is, in the case of the example 1, it is found that differences in the back and forth direction are small compared to the case of comparative example 1 and the example 1 has preferable distance stability. Because the golf club shaft of the example 1 has differences in the transverse direction smaller than those of a conventional one though the shaft of the example 1 has a torque larger than that of the conventional one and thereby, the shaft of the example 1 can be used as a stable golf club shaft. However, as a result of comparing the example 2 with the comparative example 1, it is found that the shaft of the example 2 has an extreme stability in both back and forth and transverse directions. Moreover, golf shafts of the present invention respectively have a comparatively slow response characteristic and, easily meet balls, and thereby the controllability is improved.

From the above results, it is considered that movements of a warp and weft are small because a plain weave fabric is woven. For this reason, stability is generated in a distance and direction because displacements between plain weave fabric layers and between a plain weave fabric layer and a flexural rigidity layer decrease, and a torsional rigidity is improved because movements of a warp and weft are small. According to these results, it is found that it is possible to manufacture a club particularly useful for an iron club for which stabilities of a distance and direction are requested. Moreover, because a plain weave fabric layer has a large isotropy, the feeling same as that of steel can be obtained.

EXAMPLE 3

A golf club shaft is manufactured by using the plain weave fabric shown in FIG. 2. A golf club shaft is formed by winding a plain weave prepreg (resin quantity=40%; elastic modulus of reinforcing fiber=24 t) up to 3 plies, a UD prepreg obtained by mutually overlapping an incline prepreg (resin quantity=40%; elastic modulus of reinforcing fiber=24 t) in which reinforcing fibers are diagonally set in a predetermined direction and an incline prepreg (resin quantity=40%; elastic modulus of reinforcing fiber=24 t) in which reinforcing fibers are set in the direction opposite to the predetermined direction up to 3 plies (3×2 prepregs are used), and a conventional flexural rigidity holding UD prepreg (resin quantity=24%; elastic modulus of reinforcing fiber (carbon fiber)=30 t) having reinforcing fibers aligned in parallel with the longitudinal direction of the shaft up to 4 plies on a mandrel and curing them.

Moreover, the plain weave prepreg is wound like a shaft so that the warp 51 and weft 52 are mutually crossed at an angle θ of 45° from the longitudinal direction of the shaft (refer to the arrow in FIG. 2).

Reinforcing fibers of each layer use carbon fibers. All warps and wefts of a plain weave fabric use carbon fibers. The thickness of each warp and that of each weft are 3 K and thread counts of warps and wefts are 4.9 yarns/cm respectively. Moreover, when forming a prepreg, the thickness is 0.22 mm and the weight is 328 g/cm$^2$.

Moreover, for comparison, a golf club shaft (comparative example 2) is manufactured by using six conventional UD torsional rigidity holding layers (UP prepreg 41=6 plies and UD prepreg 42=6 plies)(resin quantity=40%; elastic modulus of reinforcing fiber=24 t) and a UD flexural rigidity holding layer (resin quantity=24%; elastic modulus of reinforcing fiber=30 t) up to 4 plies. A yarn of reinforcing fibers uses carbon fibers (3 K).

Characteristics of the above golf club shaft are shown below.

TABLE 2

| | Example 3 | Comparative example 2 |
|---|---|---|
| Length | 46 in | 46 in |
| Weight | 98.4 g | 99.3 g |
| Torque | 3.2° | 2.8° |
| Frequency | 264 cpm | 264 cpm |

Golf clubs are formed by setting the same grip of 51 g and the same head of 194 g to the golf clubs (each shaft length is 45 in) to make a robot hit golf balls under the same condition. The robot is set so that positions of rbi to heads become the same for all clubs and the head speed becomes 40 m/s.

As a result of hitting 100 golf balls at the center of the head of a golf club using the shaft of the present invention, dropping points (carries) of the balls are approx. 189 yd±4 yd as differences in the back and forth direction (carry) and ±4.7 yd as differences in the transverse direction. Moreover, as a result of hitting 100 golf balls by shifting the hitting position of the head by 10 mm to the toe side, dropping points (carries) of the balls are 188.7 yd±4 yd as differences in the back and forth direction (carry) and ±8 yd as differences in the transverse direction. In this case, the differences of carry are the same as the case of hitting balls at the center of the head.

However, in the case of the golf club using a conventional shaft, dropping points of balls are approx. 188 yd±6 yd as differences in the back and forth direction (carry) and ±5 yd as differences in the transverse direction. Moreover, as a result of hitting 100 balls by shifting the hitting position to the toe side by 10 mm, dropping points of the balls are approx. 185 yd±6.6 yd as differences in the back and forth direction (carry) and ±10 yd as differences in the transverse direction.

That is, the golf club shaft of the present invention shows a very preferable distance stability compared to a conventional case. Moreover, it is found that both the golf club shafts of the present invention and the comparative example respectively have a comparatively slow response characteristic, easily meet balls, and thereby the controllability is improved. Furthermore, because the golf club shaft of the example 3 has small transverse-directional differences and therefore, the golf club shaft can be obtained as a stable golf club shaft.

The following are results of measuring characteristics of the golf club shaft of the present invention and the conventional golf club shaft.

TABLE 3

| | Example 3 | Conventional shaft | Improvement rate |
|---|---|---|---|
| Backspin | 2,600-2,700 | Approx. 3,000 | Decrease of 10% |
| Lofting angle fluctuation (Center) | | | Decrease of 30% in fluctuation |

TABLE 3-continued

| | Example 3 | Conventional shaft | Improvement rate |
|---|---|---|---|
| Carry | 189 ± 4 | 185 ± 6.6 | Decrease of 40% in fluctuation (To toe side by 10 mm) |

From the above results, it is considered that because a plain weave fabric is plainly woven, movements of a warp and weft are small, and displacements between plain weave fabric layers and between a plain weave fabric layer and a flexural rigidity layer are small and therefore, distance and direction are stabilized and torsional rigidity is improved because movements of a warp and a weft are small. Thereby, it is found that it is possible to manufacture a club particularly useful for an iron club for which stabilities of distance and direction are requested. Moreover, because a plain weave fabric layer has a large isotropy, the feeling same as that of steel can be obtained.

From the above results, it is found that in the case of the golf club shafts of the examples 1 and 3 of the present invention, differences in the back and forth direction (carry) are small and the distance stability is increased compared to a conventional case. Moreover, in the case of the example 2, it is found that not only the distance stability is increased but also differences in the transverse direction are extremely increased and therefore, the example 2 is a more preferable golf club shaft. From these results, it is found that the golf club shaft of the example 2 is most suitable as a shaft for an iron club for which small differences in the back and forth or transverse direction are requested.

As described above, according to a golf club shaft of the present invention, a plain weave fabric layer formed by impregnating the plain weave fabric with a thermosetting resin and curing the fabric is used as a torsional rigidity holding layer. The plain weave fabric is woven by warps and wefts and movements of yarns are restricted. Therefore, because a warp demonstrates a resistance against a longitudinal force and a weft demonstrates a resistance against a transverse force, it is possible to effectively retrain a deformation or a displacement between thermosetting-resin layers. Therefore, it is possible to restrain a displacement between layers at the time of a shot and the golf club shaft can be formed into a golf club shaft having a stability and a feeling same as that of a steel shaft.

EXAMPLES 4 AND 5

Figure 7:
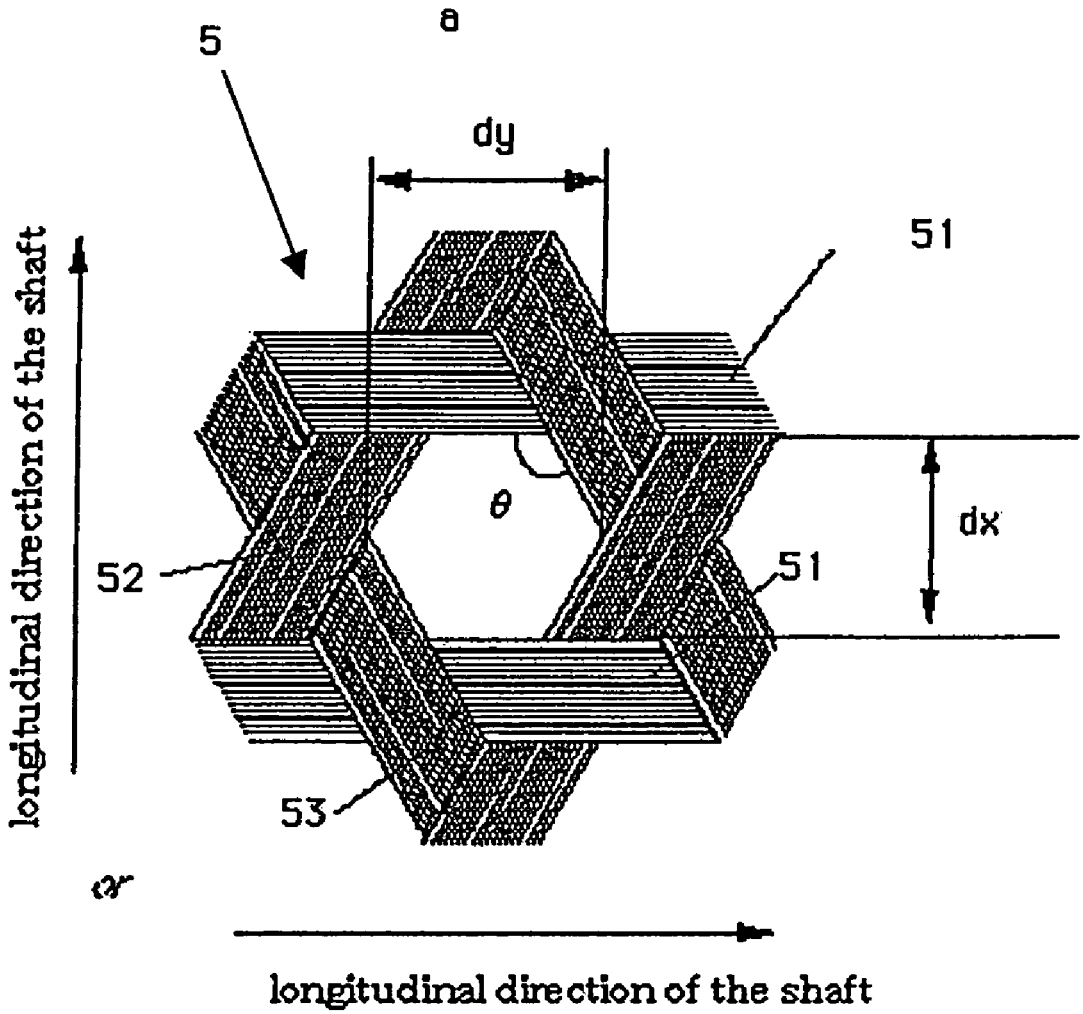
FIGS. 7*a* and 7*b* are illustrations for explaining a configuration of a triaxial fabric.
Figure 7:
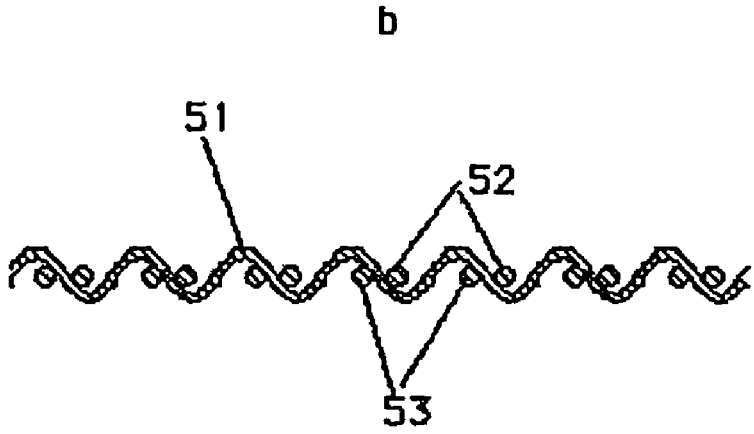

A golf club shaft is manufactured by using the plain weave fabric and a triaxial fabric shown in FIGS. 2 and 7. A golf club shaft is formed by mutually overlapping an incline prepreg 41 in which reinforcing fibers are diagonally set in a predetermined direction and an incline prepreg 42 in which reinforcing fibers are set in the direction opposite to the predetermined direction as an innermost torsional rigidity holding layer 1 and successively winding two prepreg sheets 4 in which reinforcing fibers are diagonally crossed (referred to as UD torsional rigidity holding layer) (prepreg is 2×2 plies), plain weave fabric prepreg sheets up to 3 plies, a triaxial fabric prepreg up to 1 ply, and a 0° layer prepreg up to 3 plies on a mandrel, curing the thermosetting resin of prepregs, and polishing the surface of the shaft (example 4; refer to FIG. 6).

The resin quantity of the plain weave fabric prepreg is 40% and that of the 0° layer prepreg is 25%. The plain weave fabric prepreg is wound like a shaft so that a warp and a weft are mutually crossed at an angle θ of approx. 45° from the longitudinal direction of the shaft. Carbon fibers are used for reinforcing fibers of the UD torsional rigidity holding layer, 0° layer, and plain weave fabric layer. The thickness of each warp and that of each weft of the plain weave fabric layer are 3 K respectively and the thread count of warps and that of wefts are 4.9 yarns/cm respectively. Moreover, the thickness of a prepreg is 0.22 mm and the total weight of prepreg is 328 g/m$^2$.

Furthermore, the thickness of warps and that of a weft of the triaxial fabric are set to 1 K respectively and the angle of a warp from a weft is set to 60°. A prepreg obtained by impregnating the triaxial fabric (32 gauge) with 40% of a resin is used. Moreover, the thickness of a prepreg is 0.175 mm and the total weight is 122 g/m$^2$. The prepreg is wound so as to wefts are directed to be vertical (90° direction) to the shaft.

A golf club shaft (example 5; refer to FIG. 1) is manufactured which is formed by using two of the above UD torsional rigidity holding layer, three plain weave fabric layers, and three flexural rigidity holding layers (0° layers) and moreover, for comparison, a golf club shaft (comparative example 3) is manufactured which is formed by using four of the above UD torsional rigidity holding layer and three flexural rigidity holding layers (0° layers).

45 inch Golf clubs are prepared by setting a head and a grip to the above golf shafts A (example 4), B (example 5), and C (comparative example 3).

TABLE 4

| | Frequency | Club weight | Head weight | Shaft weight | Grip weight |
|---|---|---|---|---|---|
| A | 254 | 321.9 g | 194.9 g | 71.2 g | 50.7 g |
| B | 255 | 323.3 g | 194.6 g | 72.1 g | 50.5 g |
| C | 255 | 325.7 g | 194.0 g | 74.7 g | 50.6 g |

In the above Table 4, the unit of the frequency is CPM. For torques of shafts, A is 4.26°, B is 3.98°, and C is 4.07°.

Golf balls are hit by a robot under the same condition by using the above three golf clubs. The robot is set so that positions of rbi to heads become the same for all clubs and the head speed becomes 42 m/s.

As a result of making the robot hit 100 balls at the center of the head of the golf club A using a shaft of the present invention, dropping points (carries) of the balls are approx. 205 yd±3 yd as differences in the back and forth direction (carry) and ±4.25 yd as differences in the transverse direction. Moreover, as a result of making the robot hit 100 balls by shifting the hitting position to the toe side by 10 mm, dropping points of the balls are approx. 200.7 yd±3 yd as differences in the back and forth direction (carry) and ±3.75 yd as differences in the transverse direction.

In the case of the golf club B, as a result of hitting balls at the center of the head, dropping points of the balls are approx. 206±3.75 yd as differences in the longitudinal direction (carries) and ±5.0 yd as differences in the transverse direction. Moreover, as a result of making the robot hit 100 balls by shifting the hitting position to the toe side by 10 mm, dropping points of the balls are approx. 200.6 yd±4.5 yd as differences in the back and forth direction and ±2.75 yd as differences in the transverse direction.

However, in the case of the golf club C, as a result of hitting balls at the center of the head, dropping points of balls are approx. 206 yd±5.7 yd as differences in the back and forth direction (carry) and ±6.5 yd as differences in the transverse direction. Moreover, as a result of hitting 100 balls by shifting the hitting position to the toe side by 10 mm, dropping points of the balls are approx. 202.7 yd±5.25 yd as differences in the back and forth direction and ±4.0 yd as differences in the transverse direction.

That is, the golf club shaft A of the present invention shows a preferable distance stability compared to the golf clubs B and C. Particularly in compare with the conventional UD prepreg golf club C, the golf club shaft of the present invention has improved distance and transverse and a stable golf club shaft can be obtained.

The invention claimed is:

1. A golf club shaft, comprising a torsional rigidity holding layer made of thermosetting resin including reinforcing fibers diagonally crossed in the longitudinal direction of said shaft and a UD flexural rigidity holding layer made of thermosetting resin including reinforcing fibers aligned in parallel in the longitudinal direction of said shaft, characterized in that said torsional rigidity holding layer includes a UD torsional rigidity layer and a plain weave fabric layer formed by winding like a shaft-shape a plain weave prepreg obtained by impregnating a plain weave fabric having mutually-woven warps and wefts with thermosetting resin and curing the prepreg in such a way that said warps and wefts are diagonally crossed in the longitudinal direction of said shaft, and a triaxial fabric layer formed by winding like a shaft-shape a triaxial fabric prepreg obtained by impregnating a triaxial fabric which has first warps inclined to wefts and second warps diagonally crossing with the first warps and has a structure where these warps and wefts are woven by alternately passing through upsides and downsides of yarns with thermosetting resin in such a way that said wefts become parallel with or vertical to the longitudinal direction of said shaft and curing the prepreg, and characterized in that said UD torsional rigidity holding layer, plain weave fabric layer, triaxial fabric layer, and UD flexural rigidity holding layer are laminated in this order.

2. The golf club shaft according to claim 1, characterized in that a thread count of said plain weave fabric is 4 yarns/cm or more.

3. The golf club shaft according to claim 1, characterized in that the thickness of a yarn of said plain weave fabric is 3 K or less.

4. The golf club shaft according to claim 1, characterized in that the weight of said plain weave prepreg is 400 g/cm$^2$ or less and the thickness of the same is 0.3 mm or less.

5. The golf club shaft according to claim 1, characterized in that the resin quantity of said plain weave prepreg ranges between 25 and 40 wt %.

6. The golf club shaft according to claim 1, characterized in that the angle between the warp and the weft of said plain weave fabric is 90°.

7. The golf club shaft according to claim 1, characterized in that in the case of said plain weave fabric, warps and wefts are wound so as to be substantially 45° to the longitudinal direction of said shaft.

8. The golf club shaft according to claim 1, characterized in that said triaxial fabric are 32 or 64 gauges.

9. The golf club shaft according to claim 1, characterized in that the weight of the prepreg of said triaxial fabric is 350 g/m$^2$ or less and die thickness of the same is 0.4 mm or less.

10. The golf club shaft according to claim 1, characterized in that the resin quantity of the prepreg of said triaxial fabric ranges between 25 and 50 wt %,

11. The golf club shaft according to claim 1, characterized in that the angle between warps and wefts of said triaxial fabric is 60°.

* * * * *